US008448886B2

(12) United States Patent
Santandrea

(10) Patent No.: US 8,448,886 B2
(45) Date of Patent: May 28, 2013

(54) APPARATUS AND METHOD FOR GRINDING KITCHEN WASTE

(75) Inventor: Marco Santandrea, Barberino Val d'Elsa (IT)

(73) Assignee: ATOP S.p.A., Barberino Val d'Elsa (IT)

( * ) Notice: Subject to any disclaimer, the term of this patent is extended or adjusted under 35 U.S.C. 154(b) by 243 days.

(21) Appl. No.: 12/742,385

(22) PCT Filed: Nov. 16, 2007

(86) PCT No.: PCT/IB2007/003511

§ 371 (c)(1),
(2), (4) Date: May 11, 2010

(87) PCT Pub. No.: WO2009/063265

PCT Pub. Date: May 22, 2009

(65) Prior Publication Data

US 2010/0264242 A1 Oct. 21, 2010

(51) Int. Cl.
*B02C 23/36* (2006.01)

(52) U.S. Cl.
USPC ..... 241/46.013

(58) Field of Classification Search
USPC ..... 241/46.013–46.016, 606
See application file for complete search history.

(56) References Cited

U.S. PATENT DOCUMENTS

| | | | | |
|---|---|---|---|---|
| 4,170,936 | A | 10/1979 | Eck | |
| 4,884,756 | A * | 12/1989 | Pearson | 241/42 |
| 4,910,808 | A * | 3/1990 | Roth | 4/222 |
| 5,129,590 | A * | 7/1992 | Shinya | 241/46.013 |
| 5,209,380 | A * | 5/1993 | Williams | 222/402.13 |
| 5,577,673 | A | 11/1996 | McMurphy et al. | |
| 5,673,861 | A * | 10/1997 | Miller | 241/69 |
| 5,833,151 | A * | 11/1998 | Doak | 241/37.5 |

FOREIGN PATENT DOCUMENTS

| | | |
|---|---|---|
| EP | 1 707 270 B1 | 10/2006 |
| IT | PI-2007-A-50 | 4/2007 |
| JP | 8-229425 | 9/1996 |
| WO | WO 2008/000510 A2 | 1/2008 |

* cited by examiner

*Primary Examiner* — Faye Francis
(74) *Attorney, Agent, or Firm* — Ropes & Gray LLP; Jeffrey H. Ingerman

(57) ABSTRACT

Apparatus for grinding waste material, such as kitchen waste, includes a section for loading the waste material, a section for grinding the waste material, a collector for the ground waste, and a dispenser of controlled quantities of sanitizing or cleaning powder directly onto the waste material before or after grinding, or onto internal surfaces of the apparatus, to avoid formation of hazardous substances or unpleasant odors. The powder can be dispensed directly or by a flow of air, which could be generated for example by a rotor or piston mechanism. The flow of air could fluidize the powder for dispensing. The apparatus can be sized for location under a sink.

15 Claims, 9 Drawing Sheets

APPARATUS AND METHOD FOR GRINDING KITCHEN WASTE

FIELD OF THE INVENTION

The present invention concerns an apparatus for grinding organic waste, like kitchen waste that has to be collected and disposed of.

BACKGROUND OF THE INVENTION

Known apparatus of the field of the invention that grind the kitchen waste to reduce its volume, are described in EP 1707270, in PCT/EP2007/005793 (not published), in Italian application PI2007/000050 (not published).

These apparatuses achieve that an increased amount of ground waste can be stored in disposal collectors, like the recyclable garbage bags commonly used by the public. Furthermore, the resulting ground waste can be more effective for composting processes, and thus provides an important contribution to ecology.

The mentioned apparatuses foresee a cleaning cycle which uses a mixture of water and sanitizing liquid. Once the cycle has been completed, the mixture can be eliminated through a piping system which is connected to a collection container of the apparatus that can be emptied, or to the drain system of the kitchen. Therefore, the apparatuses require connection to the water supply, and in many cases also to a drain system.

Sanitizing and cleaning of the equipment needs to be carried out thoroughly. Furthermore, the process and products for sanitizing and cleaning should not be harmful for the environment.

One of the inconveniences to be avoided in these types of machines is that waste residues remain attached to the internal walls of the apparatus, which complicates cleaning of the surfaces where the attachment occurs.

However, the use of a mixture of water and sanitizing liquid needs to occur frequently because the effect of the sanitizing liquid on the walls is limited due to its evaporation and dripping away with the water of the mixture.

The use of water and sanitizing liquid, together with the provision of a cleaning cycle, require that the apparatus be positioned near a water supply and a drain system of the kitchen. This can be a problem for who is not able to position the apparatus according to these requirements.

In addition, the use of cleaning and sanitizing liquid and the provision of a cleaning cycle require that the apparatus be provided with supplementary parts like internal valves or containers for deviating the liquids towards the drains and the collection devices. These supplementary parts increase the space occupancy of the apparatus.

SUMMARY OF THE INVENTION

It is an object of the invention to provide an apparatus for grinding solid portions of the waste, like kitchen waste wherein more simplified and less task of cleaning is possible for surfaces exposed to contact with the waste.

It is another object of the invention to provide an apparatus for grinding solid portions of the waste, like kitchen waste, wherein the decomposition of the waste is controlled by using predetermined quantities of cleaning or sanitizing products.

It is also an object of the invention to provide such an apparatus wherein the effect of the cleaning or sanitizing products on the internal surfaces of the machine lasts longer.

It is a further object of the invention to provide such an apparatus wherein it is no longer necessary to perform cleaning/sanitizing cycles with liquid products.

It is a further object of the invention to provide such an apparatus that does not require connection to the water supply or to a drain system for liquids.

It is a further object of the invention to provide such an apparatus having a reduced size, and which can be positioned in kitchens where little space is available.

Theses and other object are achieved with the apparatus of claim 1 of the present application.

In substance, the apparatus foresees a loading section for loading the waste material that needs to be treated, a grinding section for grinding the waste material that has been loaded, means for collecting the solid waste that has been ground, means for dispensing controlled quantities of powder for sanitizing and/or cleaning.

The predetermined quantities of powder can be dispensed on the waste material present in the loading section and/or on the surfaces of the loading section. Furthermore, the powder can be dispensed on the waste material that has been ground and is collected in the collecting means.

In particular, the powder comprises known powder compounds, for example biological types consisting of enzymes, which avoid transformation into substances that are hazardous for the health or are a source of bad smell. For example, although not exclusively, powder composition can be used containing proteinaceous nitrogen, enzymes, vitamins, micro-elements, macro-elements or compositions like those described in EP 0878202, based on bacteria and enzymes, used for sanitizing and deodorizing road side garbage containers.

The powder dispensed on the parts of the apparatus, like the walls of the loading section and the grinding means reduce the possibility of attachment of the waste to the treated surfaces. In fact, the powder remains attached to the surfaces and there forms a protective veil where the waste will contact without becoming attached, or if attachment occurs, cleaning will be easier during an eventual cleaning cycle that occur periodically. In particular, the enzymes reduce the possibility that the waste remains attached to the internal walls of the apparatus, thereby simplifying cleaning of those surfaces that come in contact with the waste.

An embodiment of the invention foresees a powder feeding unit comprising a ventilator and a member for fluidizing the powder. The ventilator produces a flow of air that fluidizes a powder bed. A mixture of air and powder is formed over the bed. The mixture is conveyed to various locations of the apparatus. For example, the mixture can be conveyed to the loading section and/or to the collection section for the ground waste.

In the loading section of the waste, a distributor can spray the mixture of air and powder on the loaded waste, or on the surfaces of the apparatus that are not in contact with the waste.

A nozzle system can be foreseen near the collecting means for spraying the powder on the ground waste, when the latter is being collected in the collecting means.

A second embodiment foresees a rotating surface that is capable of producing an air flow, which engages the particles of powder and sprays them in a distributed manner on the surfaces of the apparatus.

A third embodiment foresees that the user of the apparatus actuates a piston mechanism for creating a flow of air which sprays the powder in the apparatus.

According to another aspect of the invention, a method is provided for grinding organic waste, like kitchen waste, as defined in claim 14.

The apparatus of the invention can be used as a stand alone unit with the advantage that it can be positioned in a variety of locations seeing that water or drain connections for liquids may not be required.

Furthermore, the apparatus of the invention can be foreseen without requiring supplementary parts, like internal valves or containers for deviating the liquids towards the drains and collection devices, or these parts can result more simple and reduced in dimensions.

According to another aspect of the invention, an apparatus for grinding waste comprises a section for loading the waste; a section for grinding the waste; a section for collecting the waste; and the characteristic that the apparatus can be positioned under the sink unit of a kitchen. In particular, the apparatus has a depth between 30 and 54 cm, a height between 40 and 75 cm and a width between 15 and 60 cm. Preferably, the apparatus has a height which is less than 50 cm.

In a preferred embodiment, the loading section comprises a portion that is extractable from a fixed structure, therefore the waste can be loaded in the loading section from above by extracting the extractable portion from under the sink unit. The apparatus that can be positioned under the sink unit foresees means for dispensing predetermined quantities of sanitizing/cleaning powder on the waste or on the internal surfaces of the apparatus.

The apparatus of the invention can also foresee, for certain embodiments, cleaning cycles using liquids and relative draining of the liquids. However, the cleaning cycles can be performed less frequently and more effectively due to the use of powder which impedes the waste from attaching to the internal walls.

Furthermore, the apparatus according to the invention can be provided with a collection container for the ground waste, which is connected to the structure of the apparatus by means of a sealing joint to avoid that bad smell escapes. At the same time, the container is easily removed and connected to the apparatus when operations of emptying the ground waste are required.

BRIEF DESCRIPTION OF THE DRAWINGS

Further characteristics and the advantages of the apparatus according to the invention will result from the following description of some specific embodiments, which are made for exemplary reasons and without being limitative, and with reference to the accompanying drawings.

DETAILED DESCRIPTION

Figure 1:
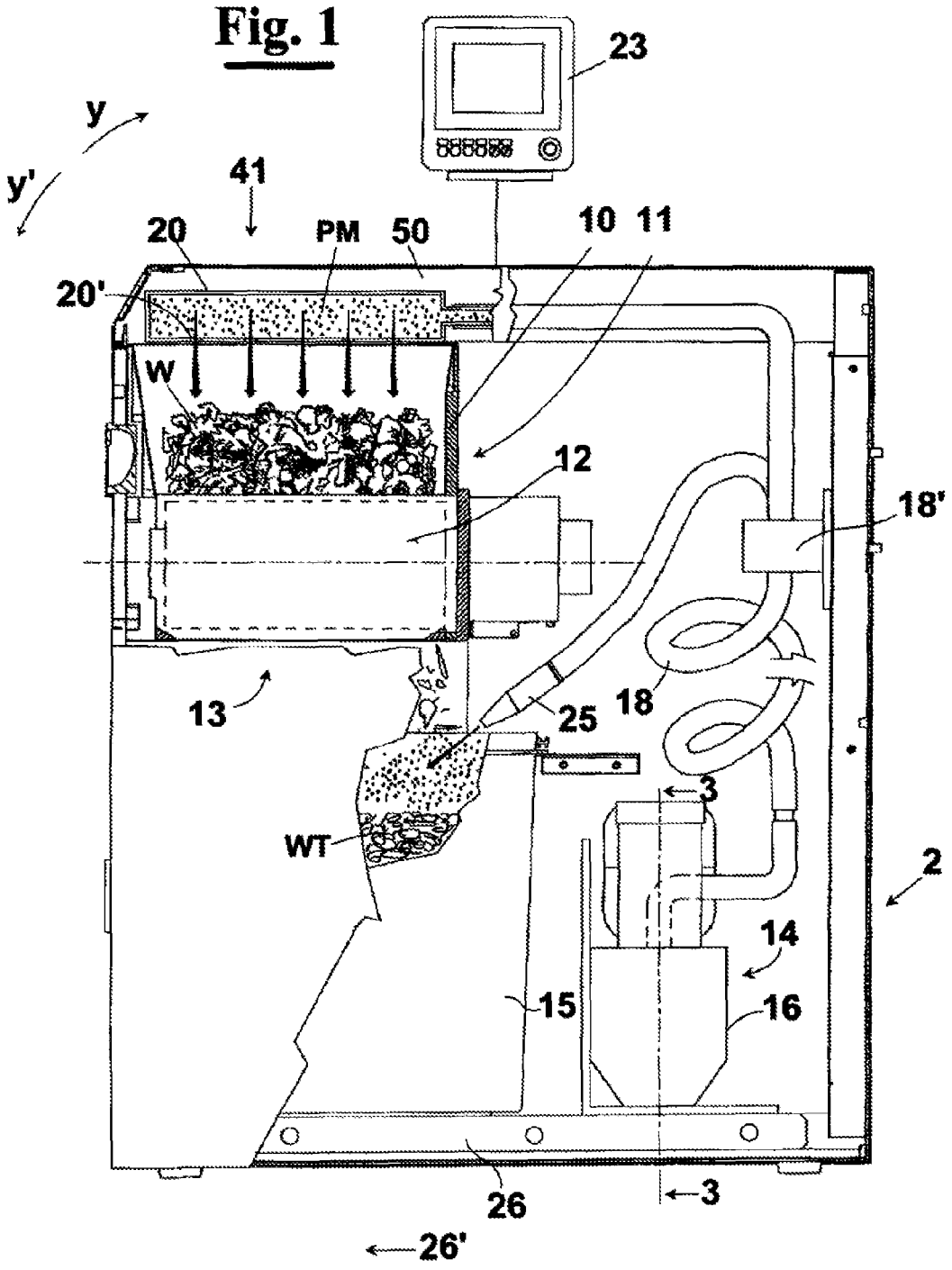
FIG. 1 is an elevation partial section view of an apparatus for grinding waste, illustrating a first embodiment of the invention.

With reference to FIG. 1, kitchen waste W can be placed by a user in basin 10 of loading section 11. From this position the waste can fall by gravity on the surface of grinding rollers 12 (shown with dashed line representation in FIG. 1). The grinding rollers can be like those described in above mentioned Italian application. The waste that has been loaded in basin 10 is conveyed towards the central area of the rollers so that grinding can occur.

The ground waste that exits the rollers from side 13 falls for example in a bag (not shown) placed in collection bin 15. Any liquid waste that is passed in the loading section can drip through the spacing existing between the rollers 12, and thus reach the collection bin 15. Alternatively, a liquid collection system (not shown) can be present on side 13 for collecting the liquid in a container which is connected to a discharge tube of the apparatus, like has been described in the above mentioned applications cited in the introductory part of the description.

The powder dispensing solution as illustrated in FIGS. 1-3*a* foresees a unit 14 for feeding the powder, which comprises chamber 16, ventilator 17 and piping 18. Unit 14 is assembled on a trolley structure 26 (FIGS. 1 and 3), which also supports bin 15

Figure 2:
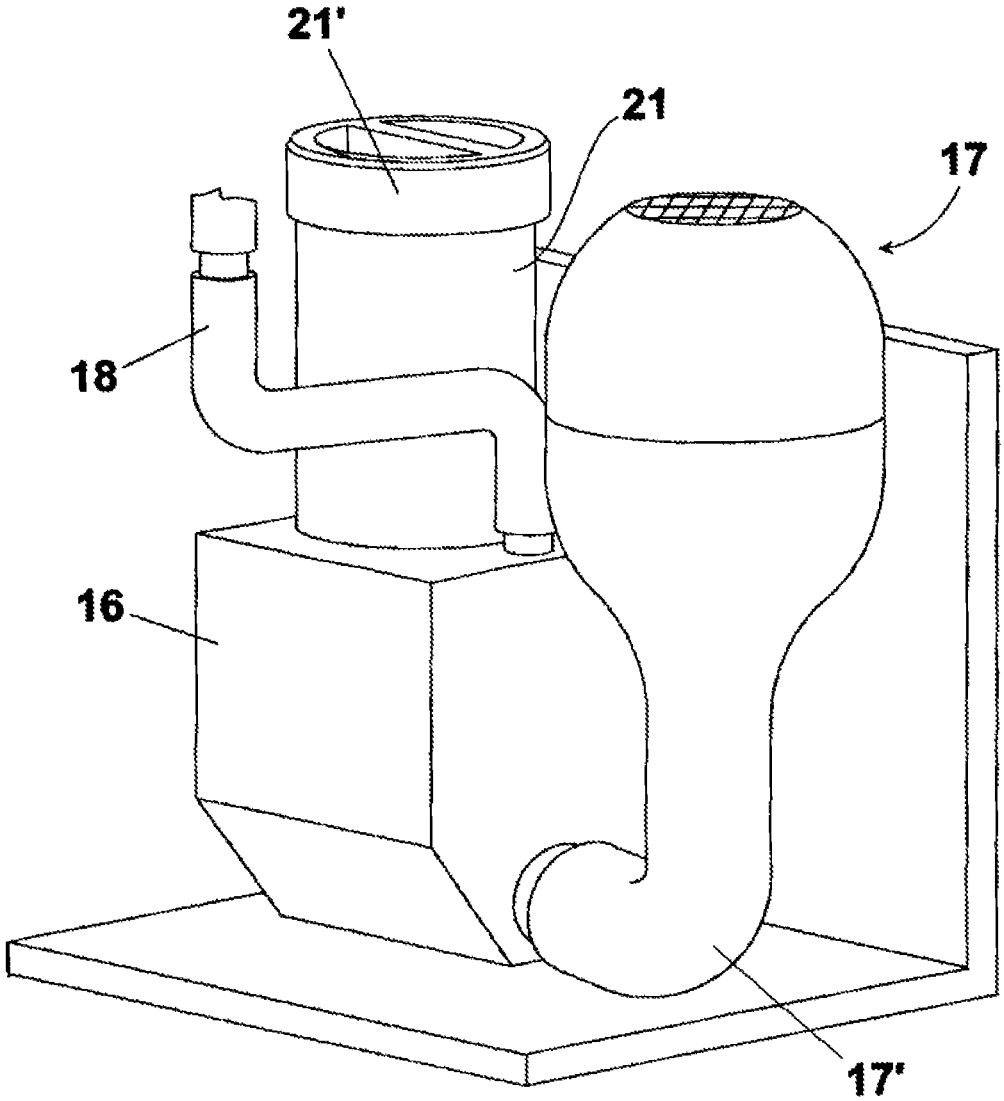
FIG. 2 is a prospective view as seen from direction 2 of FIG. 1.
Figures 3, 3A:
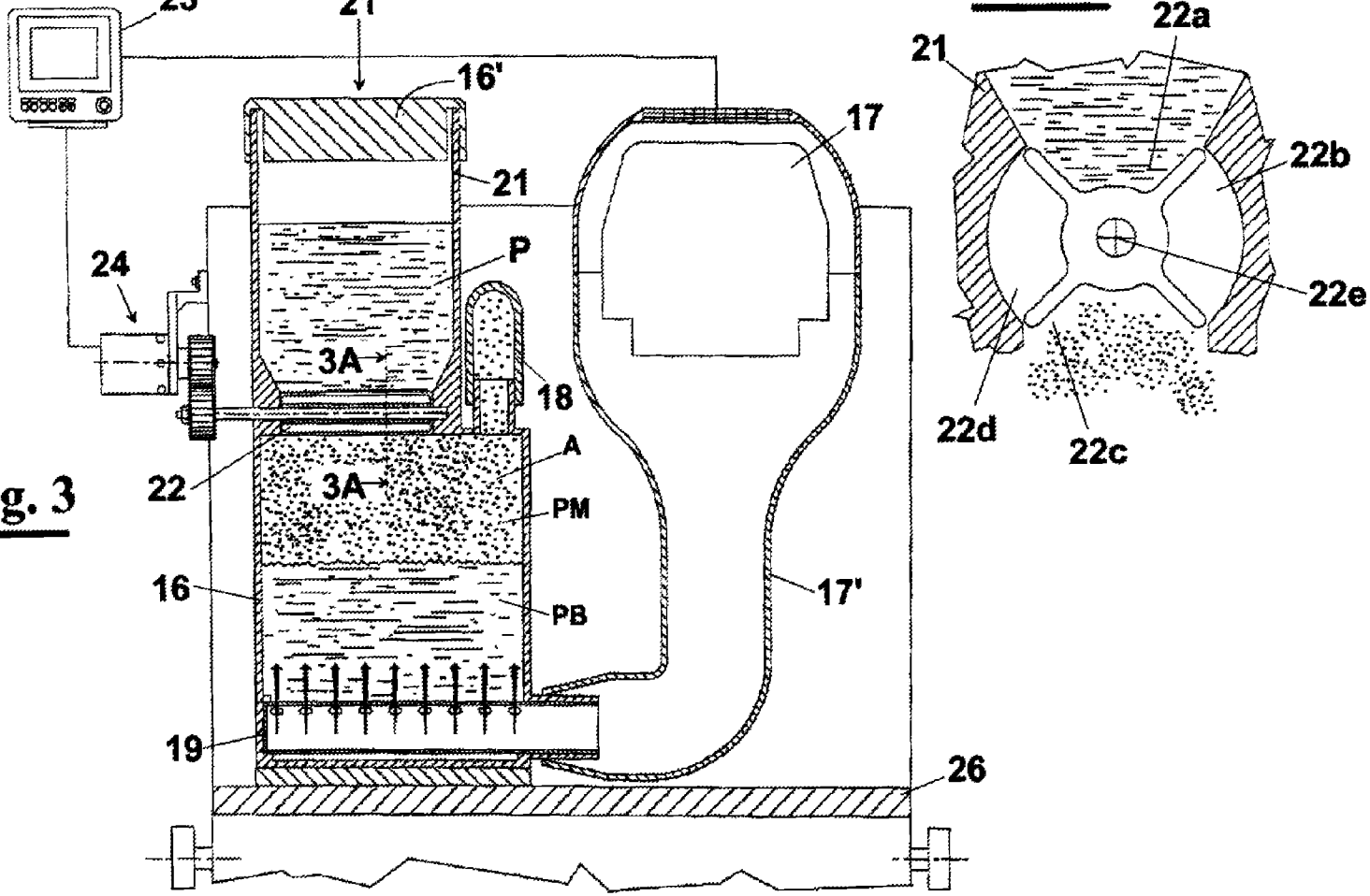
FIG. 3 is a section view as seen from directions 3-3 of FIG. 2.
FIG. 3*a* is a section view as seen from directions 3A-3A of FIG. 3.

Ventilator 17 is connected by means of conduit 17' to member 19 for fluidizing the powder (see FIGS. 2 and 3). Member 19 is positioned near the bottom of chamber 16. Member 19 can be a tube with bores facing the overhead space of chamber 16. Chamber 16 is provided with a loading channel 21, which can be opened at entrance 21' by removing tap 16'. This allows the user to load the powder through channel 21.

At the bottom of channel 21, a motorized valve 22 can release predetermined quantities of powder in chamber 16 to guarantee that a predetermined level of powder bed PB is present over fluidizing member 19. The air flow coming from ventilator 17, and which is distributed by member 19, fluidizes the powder bed PB. This creates a mixture of air and powder PM which fills space A above the powder bed.

Due to a sufficient pressure produced by ventilator 17, the mixture of air and powder PM flows though piping 18 to reach distributor 20 present in the loading section and the nozzle system 25 located in the collecting section of the waste, as shown in FIG. 1.

Distributor 20 is located over basin 10 where waste to be treated is loaded (see FIG. 1). Distributor 20 is provided with outlet openings 20' that allow the mixture of air and powder PM to be uniformly sprayed in loading section 11. In this way, the powder can be deposited on waste present in basin 10, or on the exposed surfaces of the apparatus.

The mixture PM also reaches nozzle system 25 for dispensing the powder on ground waste material that is deposited in bin 15. Depositing the powder on the ground waste can be an alternative to depositing powder on the waste in the loading section, or it can be an additional measure to increase prevention of the formation of hazardous substances and source of bad smell.

When the waste is not present in basin 10, the powder can be sprayed by distributor 20 so that it deposits on the walls of basin 10, and also on the surfaces of grinding rollers 12. The grinding rollers 12 can be rotating when this occurs. This exposes all the surfaces of the grinding rollers to the spray of powder.

Control unit 23 of the apparatus can be programmed to activate ventilator 17 when spraying of the powder needs to occur in loading section 11 and through nozzle system 25. Control unit 23 can also activate valve 22 for delivering the powder in chamber 16 so that the level of bed PB is maintained constant.

Valve 22 can be provided with compartments 22*a*-22*d* located around axle 22*e*, like is shown in FIG. 3*a*. Predetermined volumes of powder fill each compartment 22*a*-22*d* for being intermittently dropped into chamber 16 by means of rotation of axle 22*e* caused by motor drive 24 and control unit 23. The rotations of axle 22*e* are started and stopped by control unit 23 to maintain the predetermined level of the powder bed PB in chamber 16. Sensors (not shown) can detect the level of the powder bed, and therefore cause motor drive 24 to rotate valve 22. Further sensors (not shown) can detect the level of powder present in loading channel 21 and therefore signal requirement of replenishing unit 14 with powder.

The timing that ventilator 17 remains actuated is controlled by control unit 23. This timing can influence the quantity of powder that becomes sprayed in the apparatus by distributor 20 and by nozzle system 25. Control unit 23 can be programmed, for example, for causing dispensing of powder at regular intervals of the working time of the apparatus, or based on the occurrence of working cycles of the apparatus.

The user can easily reach entrance 21' of channel 21 by drawing trolley structure 26 in direction 26'. This will result in aligning entrance 21' with the user present outside the apparatus. Trolley structure 26 is drawn in direction 26' also for allowing the user to access collection bin 15 when needing to remove the ground waste from the apparatus.

The user can directly actuate dispensing of powder on behalf of unit 14 by actuating a switch of control unit 23. Furthermore, the user can change the number of cycles for dispensing the powder, the timing that ventilator remains operative, and the timing that valve 22 remains activated. All this for modifying the conditions and quantity of powder being dispensed in the apparatus.

A deviation valve 18' activated by control unit 23 can deviate flow of powder between piping going to distributor 20 and piping going to the nozzle system 25, or can maintain the flow in both piping.

Figure 4:
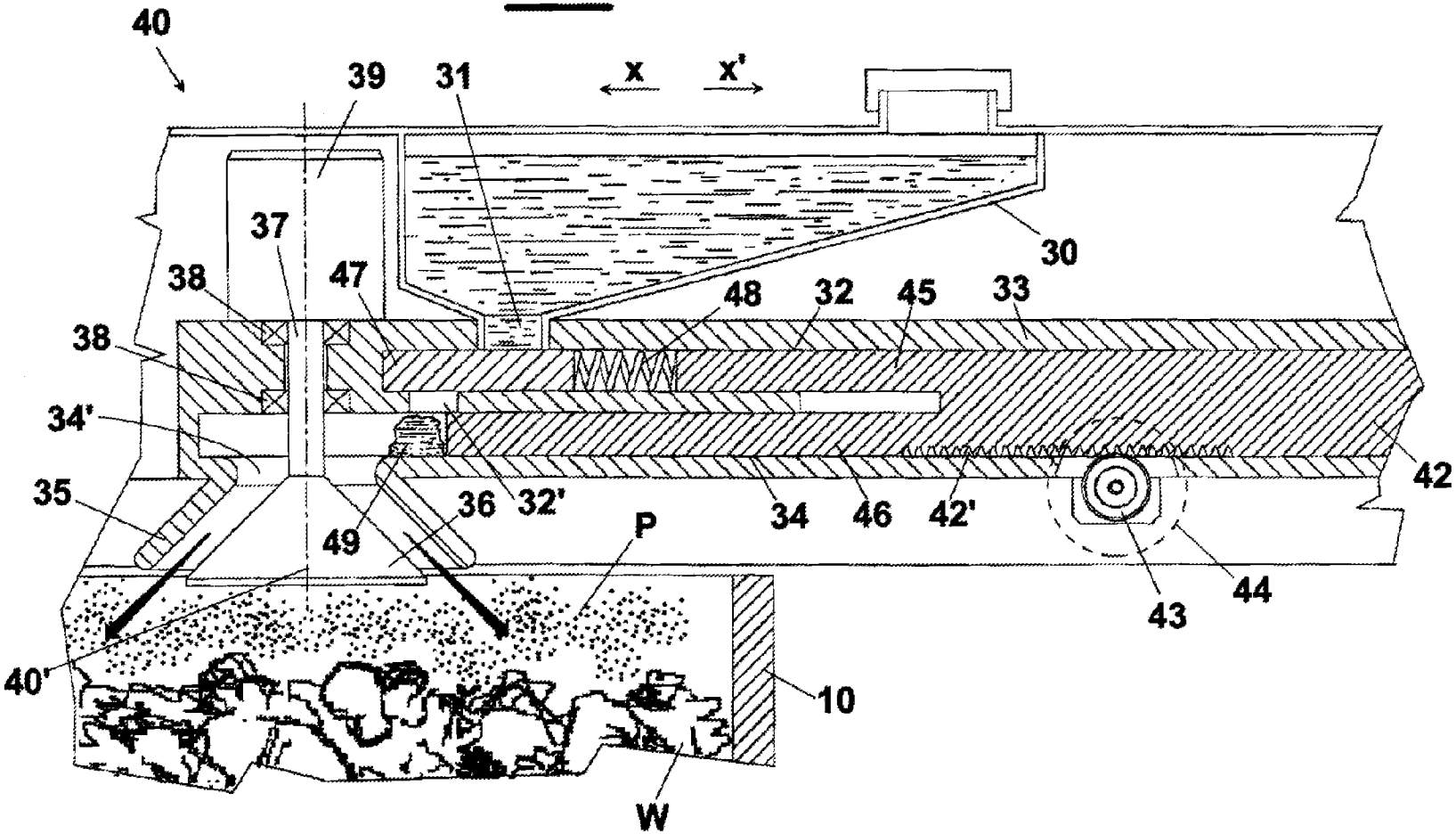
FIG. 4 is a partial section view similar to a portion of the view of FIG. 1 illustrating a second embodiment of the invention.

A further embodiment of the invention for dispensing powder in the loading section is shown in FIG. 4. The solution of FIG. 4 can be a unit 40 located overhead the loading section in central area 41, see FIG. 1.

Unit 40 does not require an air flow for dispensing the powder. The powder P can be stored in loading chamber 30 of unit 40. A calibrated opening 31 at the bottom of chamber 30 communicates with channel 32 of the support structure 33 of unit 40. Channel 32 has a calibrated opening 32' which communicates with a second channel 34 of support structure 33.

A predetermined quantity of powder 49 can fall through opening 31 into channel 32 when push shaft 47 moves rearwards in direction X' to open opening 31 towards channel 32.

Channels 32 and 34 are parallel to each other and extend longitudinally in direction X. Channel 34 is located below channel 32. Opening 32' is located more forward than opening 31 in direction X.

Opening 34' near to the end of channel 34 communicates with area 35 of support structure 33. Area 35 has a conical configuration which expands from opening 34' towards basin 10.

A rotor 36 having a conical configuration is located in section 35. Rotor 36 is supported by shaft 37, which is assembled on bearings 38 located in support structure 33. Shaft 37 is rotated by motor 39 so that rotor 36 is rotated around central axis 40' of section 35.

Actuator member 42 has a rack portion 42' which engages pinion 43 of motor 44. Bidirectional rotations of motor 44 translate member 42 backwards and forwards, i.e. respectively in directions X and X'. Rod 45 is an extension of member 42, and translates in channel 32 for the same translations accomplished by member 42. Similarly, pusher rod 46 is an extension of member 42 and translates in channel 34 for the same translations accomplished by member 42. Pusher rod 47 is more forward than pusher rod 45 in channel 32, whilst spring 48 is assembled between rod 45 and rod 47.

FIG. 4 shows an operative instant of unit 40, in which rod 46 is pushing a predetermined quantity of powder 49 through channel 34. The pushing direction is X towards opening 34' of section 35. When the powder reaches opening 34', it falls on rotor 36 which is rotating around axis 40'. The engagement of the powder on the rotor that is rotating causes the powder particles to be launched out of section 35, and therefore dispenses the powder particles into loading section 11.

The predetermined quantity of powder 49 reaches channel 34 in a previous stage when rod 47 has pushed the powder along channel 32 to make it drop though opening 32'. In an even previous stage, rod 47 has been sufficiently moved in direction X' to clear opening 31, and therefore to allow the predetermined quantity of powder to drop from loading chamber 30 into channel 32 through opening 31.

As shown in FIG. 4, spring 48 allows rod 47 to engage the end of channel 32 and at the same time allows rods 45 and 46 to continue to translate in direction X, when rod 46 needs to push the powder in channel 34 towards opening 34'.

The sequence of translation of rods 45, 47 and 46 are caused by the sequence of rotations of motor 44, which can be controlled by control unit 23 to guarantee that predetermined quantities of powder are pushed and caused to fall on rotor 36, or the user of the apparatus can directly activate motor 44 by means of switches of control unit 23 for causing the predetermined quantity of powder to be pushed and made to fall on rotor 36.

Figure 5:
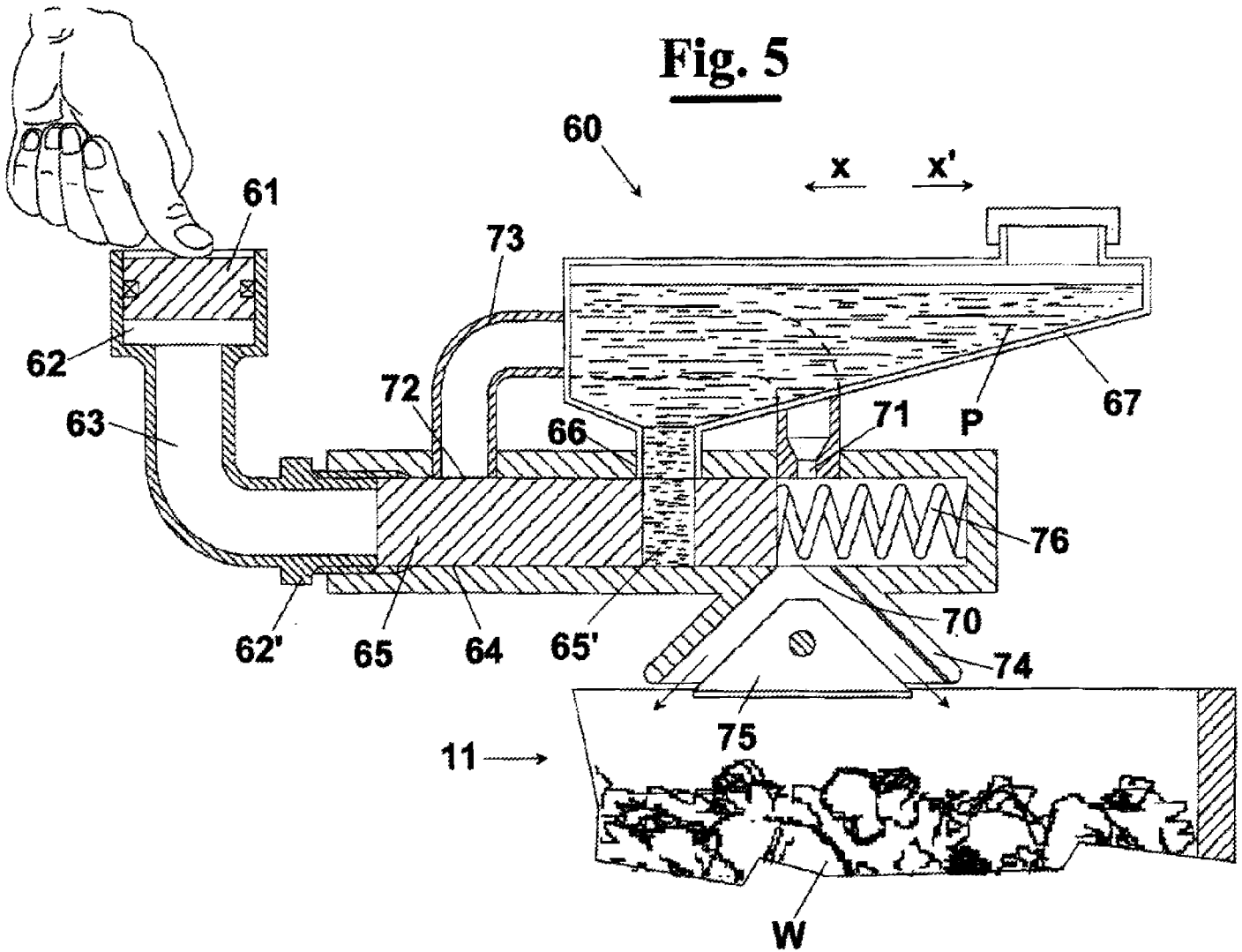
FIG. 5 is a partial section view similar to a portion of the view of FIG. 1 illustrating a third embodiment of the invention.

Unit 60 shown in FIG. 5 is a further embodiment that can be applied for dispensing powder in the loading section 11. With unit 60, the user presses on piston 61 to move it in air tight chamber 62. In this way a an air flow is caused through piping 63 which pressurizes chamber 64.

Slide member 65 is like a piston member which can translate in chamber 64 due to the push obtained by the pressurized air coming from chamber 62. Slide member 65 has passage 65' which can be aligned with opening 66 of powder reservoir 67, as shown in FIG. 5. The alignment of passage 65' with opening 66 causes a predetermined quantity of powder to fill passage 65'.

The air flow caused by the user pressing piston 61 translates member 65 in direction X', which therefore aligns passage 65' both with passage 70 and with air exit 71. During the translation of member 65, entrance 72 of by pass duct 73 is opened to deviate a portion of air flow to reach air exit 71.

Passage 70 is an exit for spraying the powder in loading section 10. Diffusion members at the exit of passage 70, enlarged section 74 and cone 75, cause the powder to be sprayed out from passage 70 onto a vast area of the loading section. Therefore, when passage 65' is aligned with passage 70 and air exit 71, the air leaving 71 sprays the powder out of passage 65' through passage 70 and into the loading section 11.

During translation of slide member 65 in direction X, spring 76 becomes preloaded. When piston 61 is released, the preload of the spring translates slide member 65 in opposite direction X to bring slide member back into engagement with cap member 62', thereby returning the situation to the condition of FIG. 5

Distributor 20 and units 40,60 can be assembled in a portion 50 of the apparatus structure (see FIG. 1). Portion 50 of the apparatus structure can function as a lid for allowing access and for closing the loading section 11. The lid can be rotated by means of hinges (not shown) in directions Y and Y', respectively for opening and closing the loading section. Piping 18 will have a suitable rotation joint (not shown) to allow the rotation of the lid.

Even though the apparatus described in the various embodiments is foreseen for use as a stand alone unit, with the advantage that it can be positioned in a variety of locations without requiring connections to the water supply or the drain for liquids, in some cases it should not be excluded to have cleaning cycles and related draining of liquids like is described in EP 1707270 and the two mentioned applications. In fact, the use of powder achieves savings in energy, water and sanitizing and cleaning liquids, which can be used during limited periodic cycles of cleaning of the machine.

Figure 6:
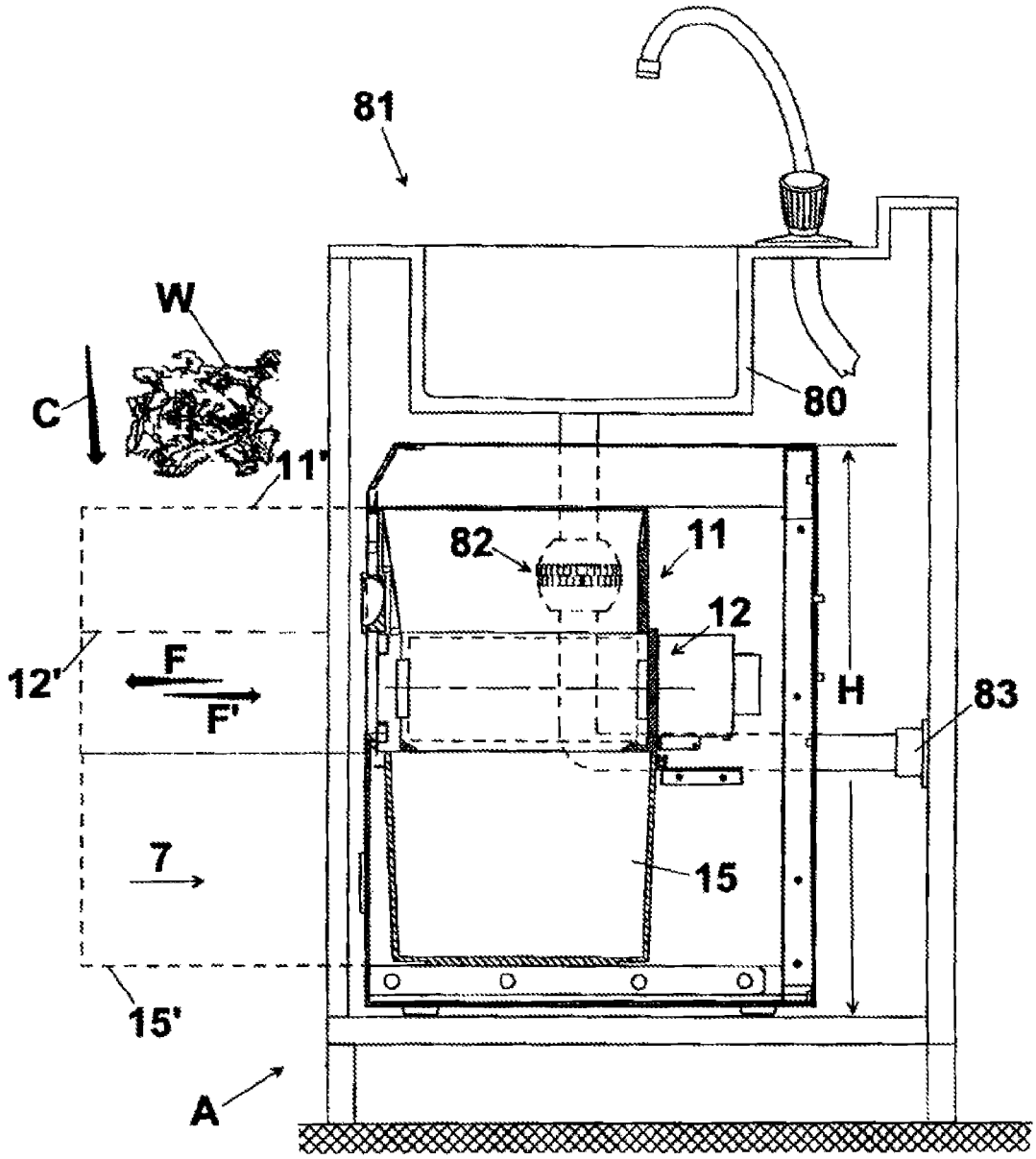
FIG. 6 is a partial section view similar to the view of FIG. 1 illustrating the apparatus of the invention positioned in the space, like is available under the sink unit of kitchens.
Figure 7:
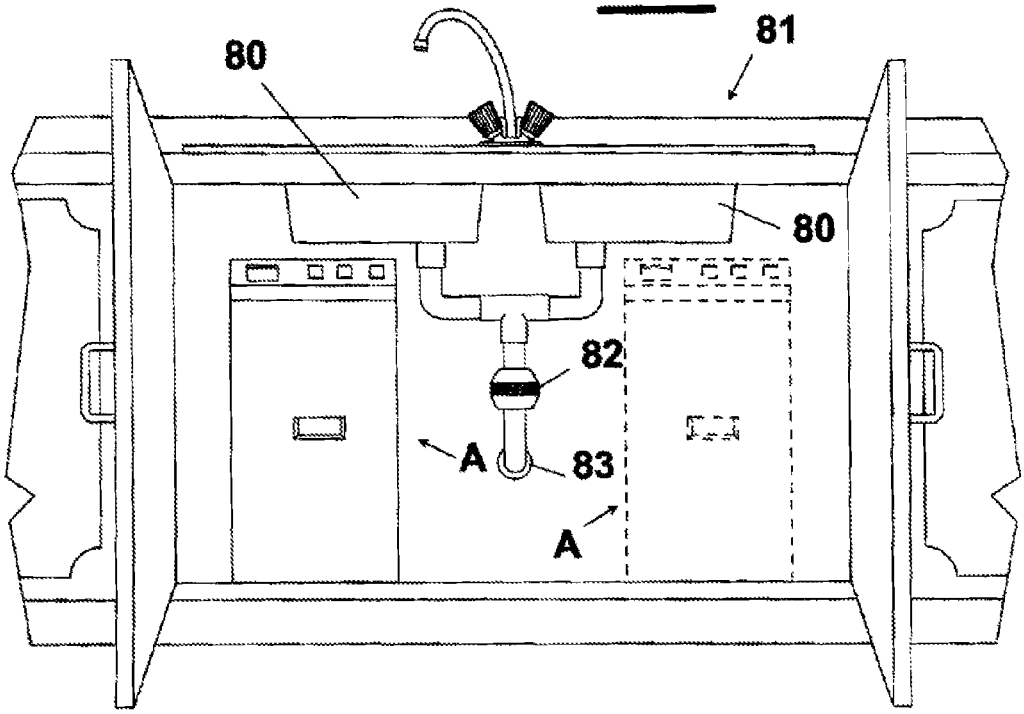
FIG. 7 is a view as seen from direction 7 of FIG. 6.

As shown in FIG. 6, the apparatus is positioned below a sink unit 81 and comprises the loading section 11, the grinding unit 12, the collection container 15 and eventually even the devices for collecting the liquids (not shown). As shown in FIGS. 6 and 7 apparatus A can be positioned in the lowest area under the sink unit 81 and more precisely under one of the sinks 80. The position of the apparatus A can be to one side with respect to the siphon 82 that is required for connection to drain 83. The overall height H of the apparatus A is less than 50 centimeters.

For loading of the waste W in section 11 of FIG. 6 (see arrow C) and emptying of the waste container 15, the user can extract from the apparatus (see movement represented with arrow F) both the loading section with the grinding section (see the external position of the loading section and the grinding section represented with the dashed line contour 11' and 12', respectively) and the collection container for the waste 15 (see the position of the collection container represented with the dashed line contour 15'). The extraction of the members 11, 12, 15 and their return to the inside position to start the grinding operation occurs respectively by pulling and pushing on the front handles of the apparatus. In this way members 11, 12, 15 move in the directions of arrows F and F'.

Figure 8:
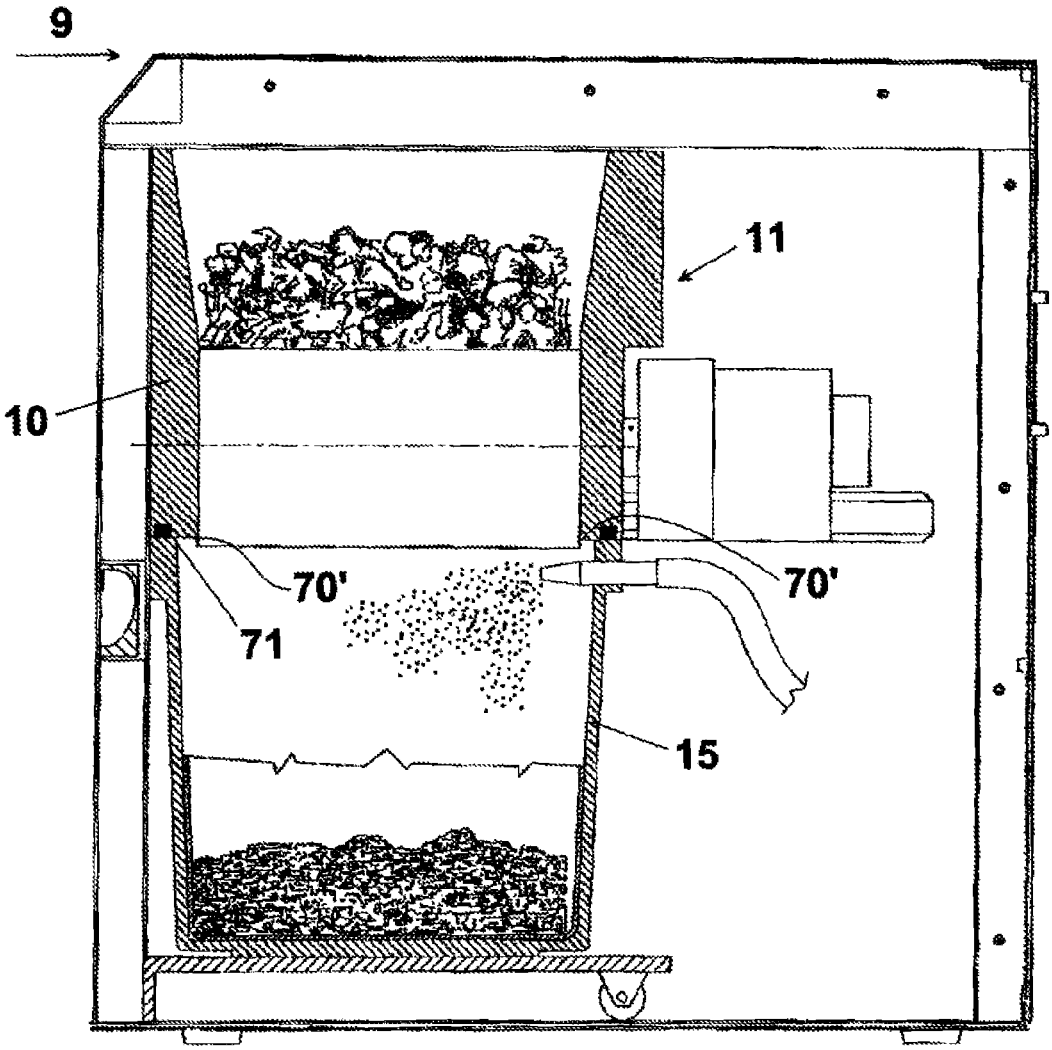
FIG. 8 is a partial section view similar to the view of FIG. 1 illustrating the apparatus of the invention with a collection container connected to the apparatus in a sealed manner.

In the section view of FIG. 8 the container for the waste 15 is in contact with the surface 70' of the frame 70 in order to become sealed and thereby avoid bad smell from escaping. Surface 70' is provided with sealing member 71, which is seated in frame 70. Frame 70 can be a portion of the structure where passage of ground waste to reach container 15 occurs. Container 15 is maintained in contact with surface 70' by means of locking members 72 (see FIG. 9), which can be actuated rapidly, as more fully illustrated in FIG. 9.

Figure 9:
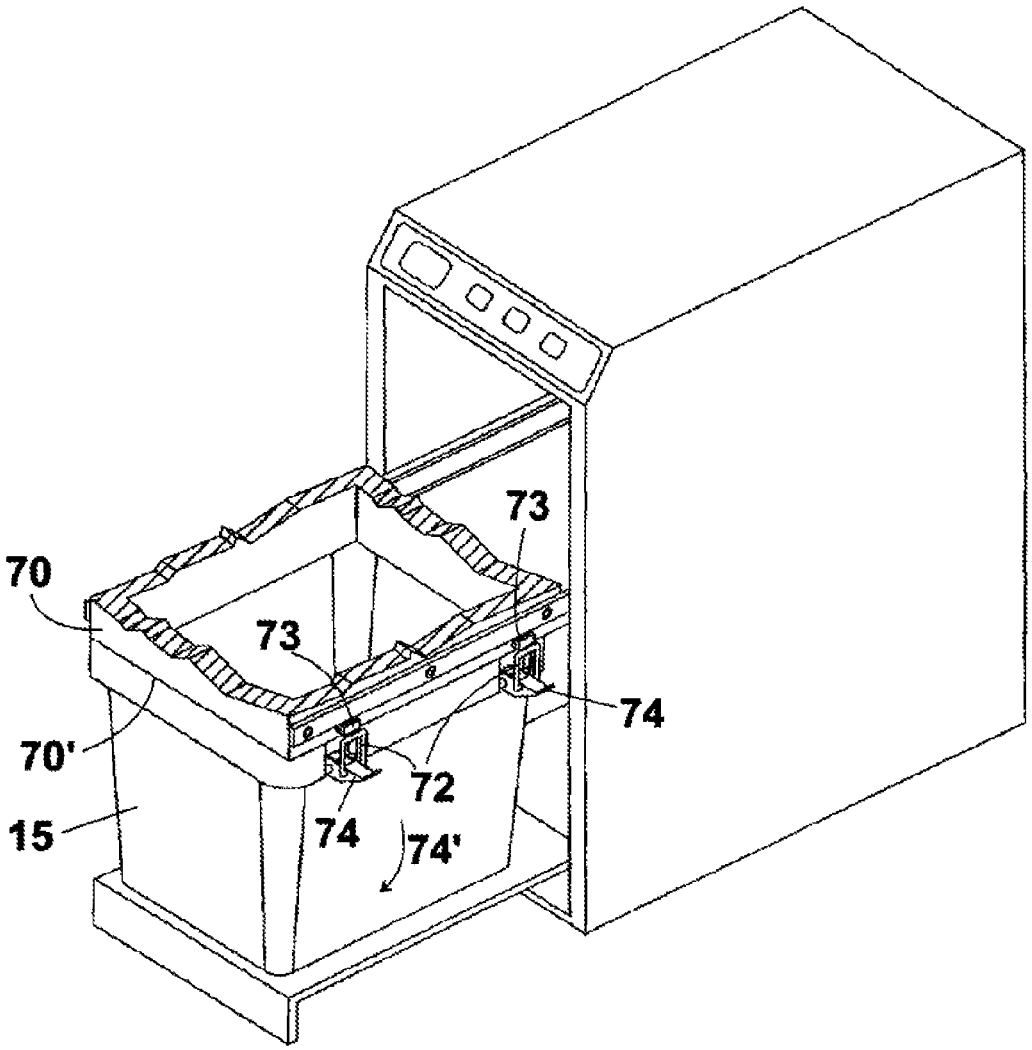
FIG. 9 is a prospective view as seen from direction 9 of FIG. 8 illustrating the solution for connecting the collection container.

In FIG. 9, for reasons of illustration, the front panel of the apparatus has been removed and container 15 is shown in the external position of the apparatus, like is the condition represented by dashed line contour 15' of FIG. 6. In FIG. 9, two locking members 72 can be seen on one side of container 15. Another two locking members are on the opposite side of the container and are not visible in FIG. 9.

The locking members 72 are hinged to respective levers 74, which are in turn hinged to container 15. Each locking member 72 hooks onto a respective hook 73 positioned on frame 70. The locking members are hooked onto the hooks and pulled by manually rotating levers 74 around pins where each lever results hinged on container 15. By rotating the levers in direction 74', the top face of container 15 is pulled against surface 70', and therefore against sealing member 71 to form the sealed joint.

The foregoing description of specific embodiments will so fully reveal the invention according to the conceptual point of view, so that others, by applying current knowledge, will be able to modify and/or adapt for various applications such an embodiment without further research and without departing from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Apparatus for grinding waste material to be disposed of in a kitchen environment comprising;

a loading section with a container for the waste material that needs to be ground;

a grinding section with a grinder for the waste material;

a collecting section for the solid waste that has been ground; and a dispenser of predetermined quantities of sanitizing/cleaning powder onto the waste material or onto the internal surfaces of the apparatus, the dispenser comprising:

a sprayer, a reservoir where the powder is loaded and stored in the apparatus, a passage for the powder between the reservoir and the sprayer, a feeder of the powder from the reservoir to the sprayer via the passage, and a controller that causes the feeder to feed the predetermined quantities of the powder to the sprayer.

2. Apparatus of claim 1 wherein the sprayer is located in the loading section.

3. Apparatus of claim 1 wherein the sprayer is located in the collecting section.

4. Apparatus of claim 1 wherein the feeder comprises a ventilator and fluidizes the powder.

5. The apparatus of claim 4 wherein the powder forms a powder bed and the ventilator produces a flow of air though the powder bed for producing a fluidized mixture of air and powder that is conveyed to the sprayer.

6. Apparatus of claim 1 wherein the dispenser comprises a distributor for spraying the powder into the loading section.

7. Apparatus of claim 1 wherein the sprayer comprises a nozzle system for spraying the powder into the collecting section.

8. Apparatus of claim 1 wherein the dispenser further comprises a moveable surface for engaging the powder to spray the powder into the loading section.

9. Apparatus of claim 1 wherein the dispenser is part of a moveable lid of the loading section.

10. Apparatus of claim 1 wherein sanitizing/cleaning is accomplished without use of liquid to be disposed of through a drain.

11. Apparatus of claim 1 comprising a collection container as part of the collection section and a seal between the collection container and the apparatus.

12. Apparatus of claim 1 characterized in that the apparatus can be positioned under the sink unit of a kitchen.

13. Apparatus of claim 12 wherein the apparatus has a depth between 30 and 54 cm, a height between 40 and 75 cm and a width between 15 and 60 cm.

14. Apparatus of claim 12 wherein the height of the apparatus is less than 50 cm for locating the apparatus below the sink of the sink unit.

15. Apparatus of claim 12 wherein the loading section comprises a portion that is extractable from a fixed structure for loading waste in the loading section from above by extracting the extractable portion from under the sink unit.

* * * * *